US005248197A

United States Patent [19]

Storf et al.

[11] Patent Number: 5,248,197

[45] Date of Patent: Sep. 28, 1993

[54] BLENDING SILO WITH COMPARTMENTALIZED FUNNEL

[75] Inventors: Robert Storf, Weingarten; Norbert Wohnhas, Ravensburg; Hans Hoppe, Vogt, all of Fed. Rep. of Germany

[73] Assignee: Waeschle Maschinenfabrik GmbH, Ravensburg, Fed. Rep. of Germany

[21] Appl. No.: 867,969

[22] Filed: Apr. 13, 1992

[30] Foreign Application Priority Data

Apr. 19, 1991 [DE] Fed. Rep. of Germany ..... 4112884

[51] Int. Cl.[5] ..... B01F 13/02

[52] U.S. Cl. ..... 366/341; 222/564; 366/101; 366/137

[58] Field of Search ..... 222/145, 188, 459, 464, 222/564; 406/119, 157, 181, 191, 195; 414/288, 293; 366/9, 101, 106, 107, 136, 137, 154, 159, 341

[56] References Cited

U.S. PATENT DOCUMENTS

| | | | |
|---|---|---|---|
| 2,455,572 | 12/1948 | Evans | 222/145 X |
| 2,884,230 | 4/1959 | Pyle et al. | 366/106 |
| 2,994,460 | 8/1961 | Matthews | 222/145 |
| 3,145,975 | 8/1964 | Towns, Jr. | 366/137 |
| 3,216,629 | 11/1965 | Goins | 366/159 X |
| 3,351,248 | 11/1967 | Baehr | 222/564 X |
| 4,027,920 | 6/1977 | Wennerstrom | 406/181 |
| 4,030,633 | 6/1977 | Fisher | 222/145 X |
| 4,286,883 | 9/1981 | Johanson | 366/341 X |
| 4,360,044 | 11/1982 | Wisneski | 222/564 X |
| 4,384,789 | 5/1983 | Avery, Jr. | 222/464 X |
| 4,478,517 | 10/1984 | Hoppe et al. | 222/564 X |
| 4,486,101 | 12/1984 | Brar | 366/101 |
| 4,548,342 | 10/1985 | Fisher | 222/564 X |
| 4,818,117 | 4/1989 | Krambrock | 366/101 X |
| 4,869,622 | 9/1989 | Salter et al. | 222/195 X |
| 5,005,983 | 4/1991 | Draffen et al. | 366/341 X |
| 5,074,670 | 12/1991 | Paul | 366/101 |

FOREIGN PATENT DOCUMENTS

| | | | |
|---|---|---|---|
| 2001831 | 5/1990 | Canada | 366/101 |
| 0060046 | 9/1982 | European Pat. Off. . | |
| 1298511 | 7/1969 | Fed. Rep. of Germany . | |
| 2219397 | 8/1974 | Fed. Rep. of Germany . | |
| 3029393 | 3/1982 | Fed. Rep. of Germany . | |
| 2136407 | 9/1984 | United Kingdom | 222/564 |

*Primary Examiner*—Harvey C. Hornsby
*Assistant Examiner*—Charles Cooley
*Attorney, Agent, or Firm*—Henry M. Feiereisen

[57] ABSTRACT

A blending silo of the type having a silo vessel defining a center axis and provided with a conical bottom ending in a vessel outlet, includes a funnel with its longitudinal axis coinciding with the center axis of the silo vessel and with its interior space being subdivided by a plurality of sheet segments in several compartments which are successively arranged in circumferential direction such that neighboring compartments have differently sized inlet cross sections and/or outlet cross sections to attain a superior homogenizing of bulk material.

19 Claims, 9 Drawing Sheets

BLENDING SILO WITH COMPARTMENTALIZED FUNNEL

BACKGROUND OF THE INVENTION

The present invention refers to a blending silo, and in particular to a blending silo of the type having a silo vessel with conical bottom ending in a central outlet.

A blending silo of this type can be designed as gravity mixer or as circulation mixer. For both applications, it is known to equip the silo vessel with internal fittings by which a high mixing degree of bulk material during a single run is attained, i.e. a good homogenizing of different and usually sequentially charged bulk material, or—in case of circulation mixers—the number of and thus the mixing time for circulations is kept to a minimum.

DE-AS 1,298,511 and EP-Al-0,060,046, both describe a blending silo with its interior being divided in several compartments by vertical sheet segments which radially extend from the outer vessel wall to the center axis. These sheet segments are provided with respectively graduated upper edges to allow successive filling of the compartments when suitably positioning the feed opening, through overflow of one compartment after another Instead of the otherwise occurring purely horizontal arrangement in layers, a vertical pre-mixing effect is thereby created, which however is dependent on the charge quantity.

German patent no. DE-PS 22 19 397 discloses a blending silo in form of a circulation mixer in which the central riser pipe is surrounded by an essentially shorter pipe which defines a first annular space with the riser pipe and a second annular space with the vessel wall of the silo and its conical bottom. During circulation or during withdrawal of bulk material, the sinking speed of bulk material in both annular spaces varies so that bulk material fractions from different level can be blended in the outlet area. German publication DE-OS 30 29 393 describes a gravity-circulation mixer which is based upon a similar principle; however, the circulation is not attained via a central pipe, but by means of a vertical riser pipe which extends externally of the silo vessel.

Common to all these known blending silos is their drawback that the internal fittings are subjected to considerable static and dynamic loads which require complicated calculations with regard to stability and dimensioning and usually exclude a subsequent modification of a silo vessel. Even though conventional blending silos are dimensioned based upon mass flow conditions, deposits of bulk material are encountered which at least complicate a cleaning of the silo vessel. However, users increasingly demand a capability for easy cleaning of the silo vessel before charging the blending silo with a different type of bulk material.

SUMMARY OF THE INVENTION

It is thus an object of the present invention to provide an improved blending silo obviating the afore-stated drawbacks.

In particular, it is an object of the present invention to provide an improved blending silo provided with structurally simple internal fittings by which a high mixing degree attained and which can be subsequently installed, and yet allow the blending silo to be easily washed out and cleaned.

These objects, and others, which will become apparent hereinafter, are attained in accordance with the present invention by providing a funnel with its longitudinal axis coinciding with the center axis of the silo vessel and with its interior space being divided by a plurality of sheet segments in several compartments which are successively arranged in circumferential direction such that neighboring compartments have differently sized inlet cross sections and/or outlet cross sections.

The provision of such compartments allows formation of approximately tubular flow zones above the funnel in which bulk material fractions sink at different speeds in accordance with the selected inlet cross sections and/or outlet cross sections of the compartments. As a result, bulk material fractions originating from different levels in the silo vessel are blended in the area of the outlet cross sections, together with the bulk material fraction flowing from the annular space between the funnel and the inside wall surface of the conical bottom. It will be understood that the overall construction is certainly based upon the observation of mass flow conditions.

Suitably, the silo vessel includes a center pipe which supports the sheet segments and which may serve as riser pipe in case a blending silo according to the invention is operated as a circulation mixer.

The various inlet cross sections and/or outlet cross sections of successive compartments can be created by alternately tilting the sheet segments about an angle relative to the respective longitudinal planes containing the center axis of the silo vessel, or by gradually increasing the inlet cross sections and/or outlet cross sections of successive compartments, preferably at a constant ratio.

According to another feature of the present invention, also the space between the funnel and the inner wall surface of the bottom is divided in compartments by further sheet segments which are of the same kind as those sheet segments placed in the space between funnel and center pipe.

According to yet another feature of the present invention, each of the sheet segments has an upper edge which extends slantingly upwards from the upper perimeter of the funnel toward the center axis of the silo vessel at an angle exceeding the angle of static friction of bulk material. Preferably the upper edge of each sheet segment is provided with a projection extending beyond the upper perimeter of said funnel. In this manner, angel hair, i.e. strands or bands of bulk material, which occurs in a preceding conveying process, can slide along the upper edge of each sheet segment and drop in the space between the funnel and bottom, and thus is prevented from depositing upon the upper edge of the sheet segments and from constricting the respective inlet cross sections.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
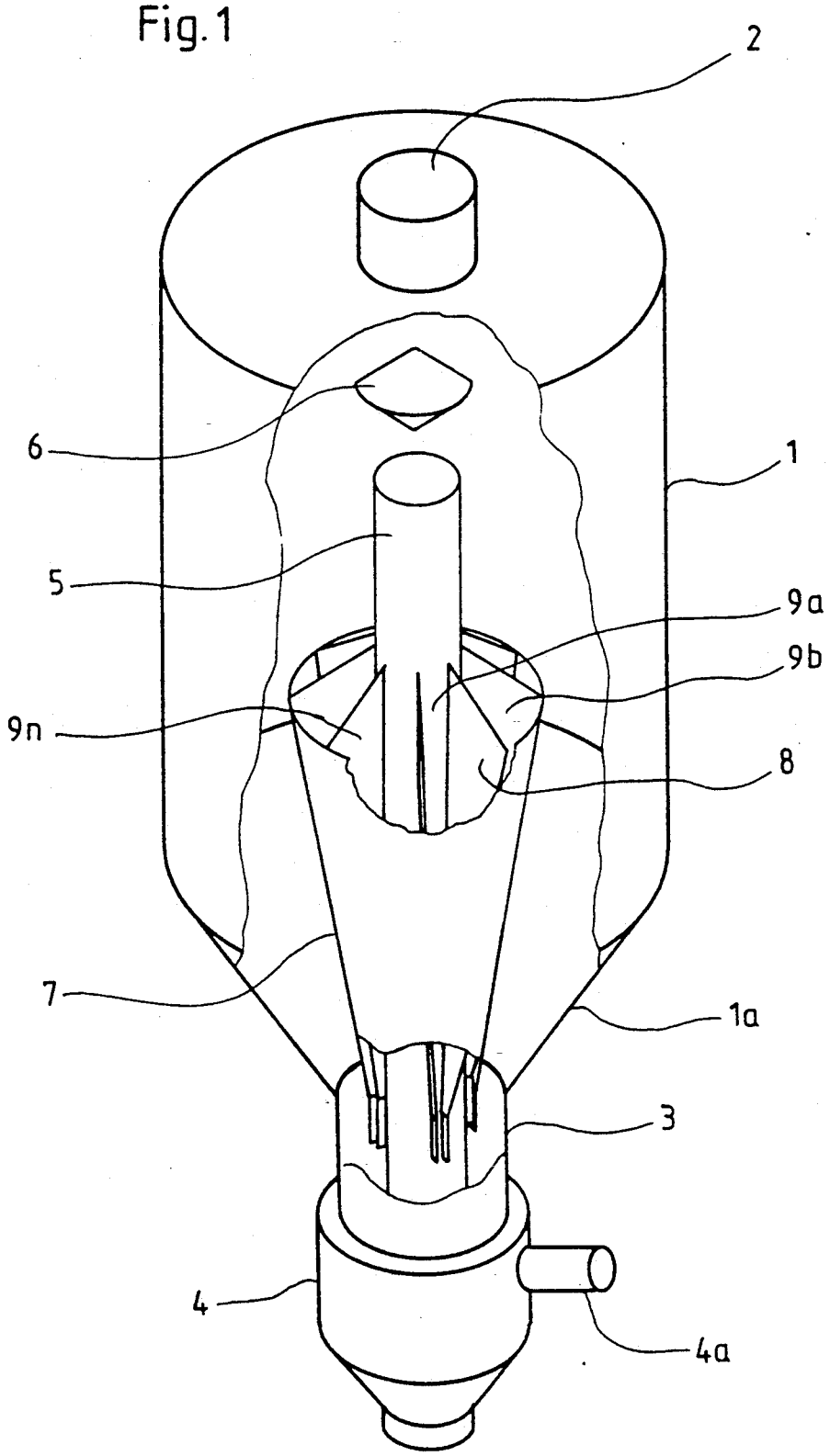
FIG. 1 is a perspective illustration of a first embodiment of a blending silo according to the present invention.

Throughout all the Figures, the same or corresponding elements are always indicated by the same reference numerals.

Referring now to the drawing, and in particular to FIG. 1, there is shown a perspective illustration of a first embodiment of a blending silo according to the present invention, including a silo vessel 1 which is provided at its lower end with a conical bottom 1*a* and is closed at its upper end by a lid 2. At a central location thereof, the lid 2 is provided with a feed opening 2*a* by which material, such as bulk material, is charged. The bottom 1*a* of the silo vessel 1 ends in a central vessel outlet 3. In the nonlimiting example of FIG. 1, the blending silo is designed as a circulation mixer, and thus includes a mixing drum 4 connected to the outlet 3 and provided with a conduit 4*a* for allowing supply of circulation air. Arranged centrally within the vessel 1 is a vertical center pipe 5 which serves as riser and extends at a vertical distance from a deflection cone 6.

In the area of the bottom 1*a* of the silo vessel 1, the center pipe 5 is surrounded by a funnel 7 which tapers in direction of the bottom 1*a* and defines with the center pipe 5 an interior space which is divided in a plurality of compartments 9*a*, 9*b* ... 9*n* by respective sheet segments 8 which essentially radially extend from the inside wall surface of the funnel 7 toward the center pipe 5. In the embodiment of the blending silo of FIG. 1, the compartments 9*a* to 9*n* have same (upper) inlet cross sections but different (lower) outlet cross sections as will be described in more detail furtherbelow.

Figure 2:
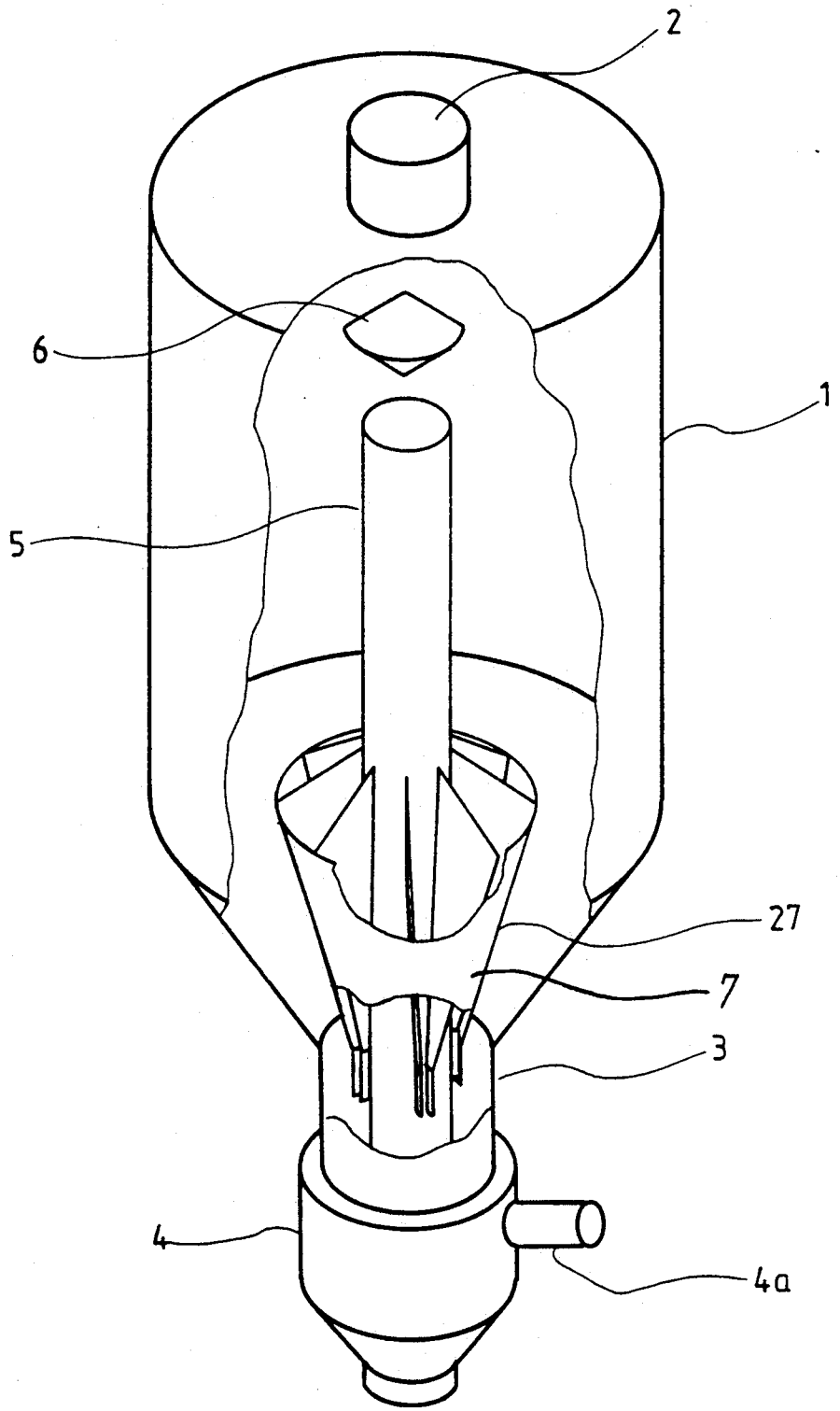
FIG. 2 is a perspective illustration of a second embodiment of a blending silo according to the present invention.

In FIG. 2, there is shown a perspective illustration of a second embodiment of a blending silo according to the present invention which differs from the blending silo of FIG. 1 solely in the design of the funnel 7 which compared to the funnel 7 of FIG. 1 is shorter and has a greater cone angle.

Persons skilled in the art will understand, however, that neither the length (height) of the funnel 7 nor the cone angle of the funnel is of any criticality for the design of the funnel 7. The variation of the blending silos of FIGS. 1 and 2 with regard to the funnel 7 has been shown merely for illustrative purposes to underline this fact. Also, even though the funnel 7 is shown to project in the central outlet 3, this design is also not critical. It is certainly feasible to arrange the lower end of funnel 7 at a vertical distance to the outlet 3 i.e. above the respective outlet cross section. Thus, the funnel 7 can be dimensioned in an optimal manner to best suit a respective application and to allow existing blending silos to be subsequently modified to incorporate a funnel according to the invention.

When using a blending silo according to the invention as a pure gravity mixer, the mixing drum 4 is substituted by a conventional locking or discharge element, such as a rotary feeder, and the top of the center pipe 5 can then be closed off so as to merely serve as support for the sheet segments 8 which are mounted to the center pipe 5 along their inner, approximately vertical edges. Also, the deflection cone 6 (or at least its lower cone surface) can be omitted.

Figure 3:
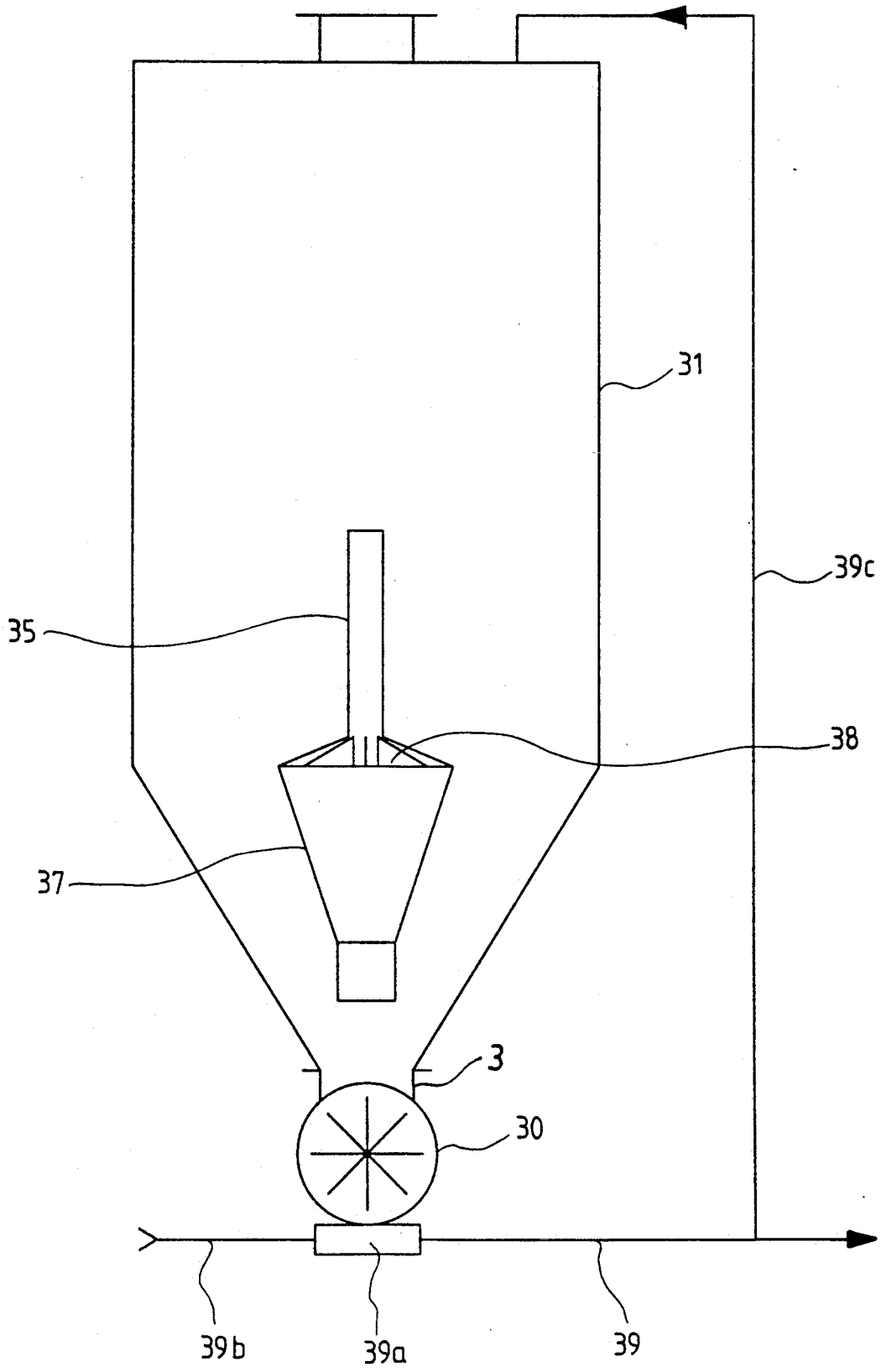
FIG. 3 is a schematic longitudinal section of an exemplified blending silo in accordance with the present invention, with the blending silo being designed as gravity mixer.

Turning now to FIG. 3, there is shown a schematic longitudinal section of such an exemplified blending silo of the gravity mixer type, with the bottom outlet 3 of the silo vessel 1 communicating with a locking element in form of a rotary feeder 30. The outlet of the rotary feeder 30 cooperates with a charging device 39*a* of an only schematically illustrated pneumatic transport pipe 39 which is supplied with compressed air via conduit 39*b* and includes a conduit 39*c* for possible circulation and return of bulk material discharged from the silo vessel 1. The central pipe 5 is provided only for support of the sheet segments 8 by which the interior space of funnel 7 is subdivided in single compartments.

Figure 4:
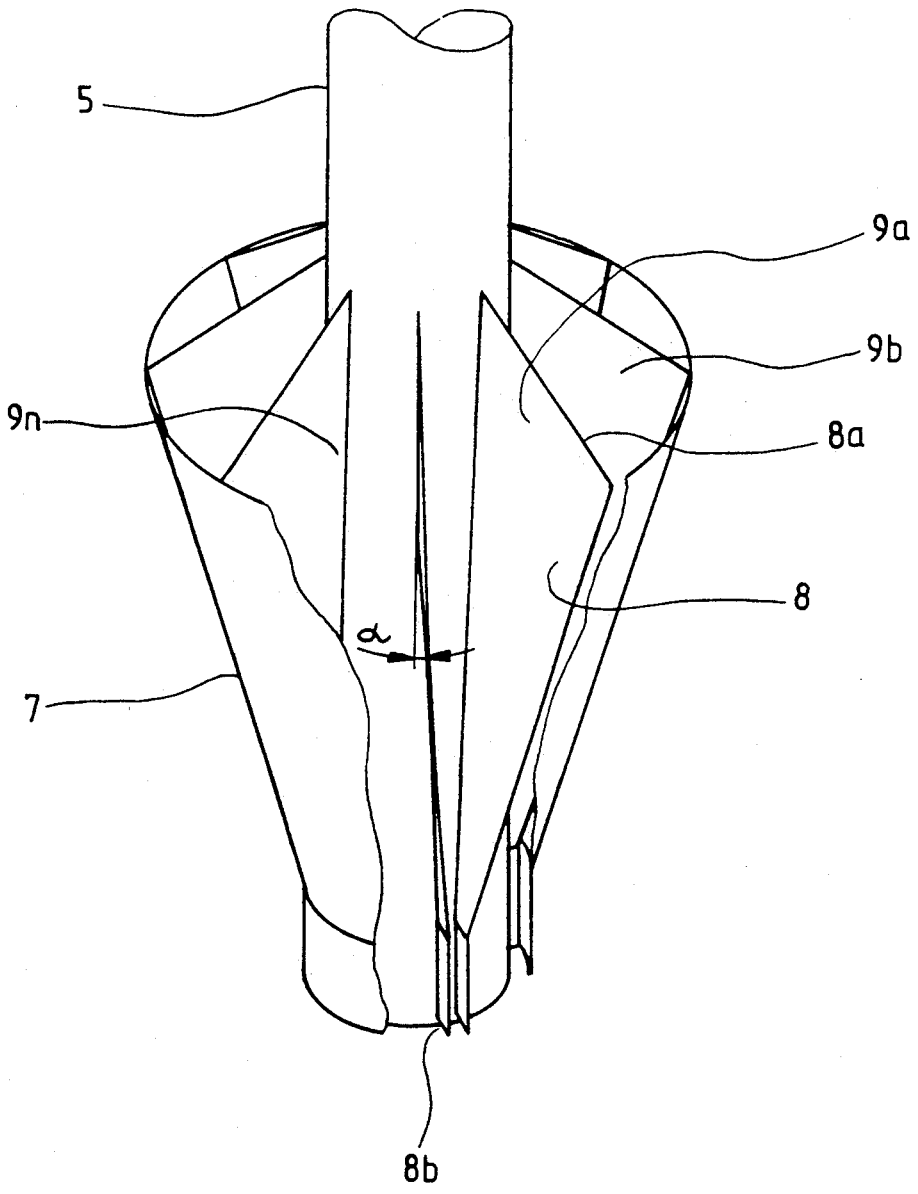
FIG. 4 is a perspective view, on an enlarged scale, of an exemplified funnel installed within the blending silo of FIG. 2.

Turning now to FIG. 4, there is shown, on an enlarged scale, a perspective view of an exemplified funnel 7 which is mounted within the blending silo of FIG. 2. The sheet segments 8, extending between the funnel inside wall and the center pipe 5 to separate the funnel 7 in compartments 9*a* to 9*n*, have upper edges 8*a* which are equidistantly arranged from each other to provide the compartments 9*a* to 9*n* with same inlet cross sections. In order to provide neighboring compartments 9*a* to 9*n* with different outlet cross sections, circumferentially successive sheet segments 8 are tilted in alternate direction about an angle a relative to the longitudinal planes containing the center axis of the silo vessel 1. The sheet segments 8 are tilted about the point in which the upper edge 8*a* of the respective sheet segment 8 meets the center pipe 5. Certainly, the tilting point may also lie in the center between the upper edge 8*a* and the lower edge 8*b* of the respective sheet segment. In this case, neighboring compartments have different inlet cross sections as well as different outlet cross sections. Certainly, it is also feasible to arrange the sheet segments 8 about the center pipe 5 with their lower edges being arranged equidistantly from each other, and to tilt the sheet segments 8 about the point of connection of the respective lower end 8*b* with the center pipe 5 so that neighboring compartments have differently sized inlet cross sections but identical outlet cross sections. The latter possibilities are not illustrated in detail but demonstrate the structural versatility of the funnel 7.

Figure 5:
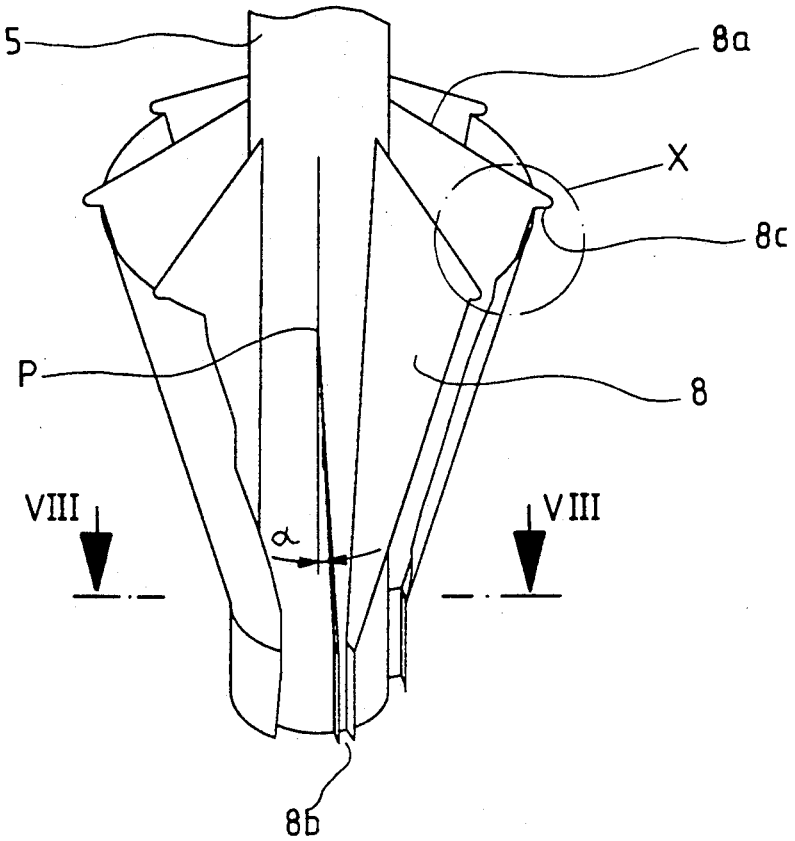
FIG. 5 is a perspective view of a variation of the funnel of FIG. 4.
Figure 7:
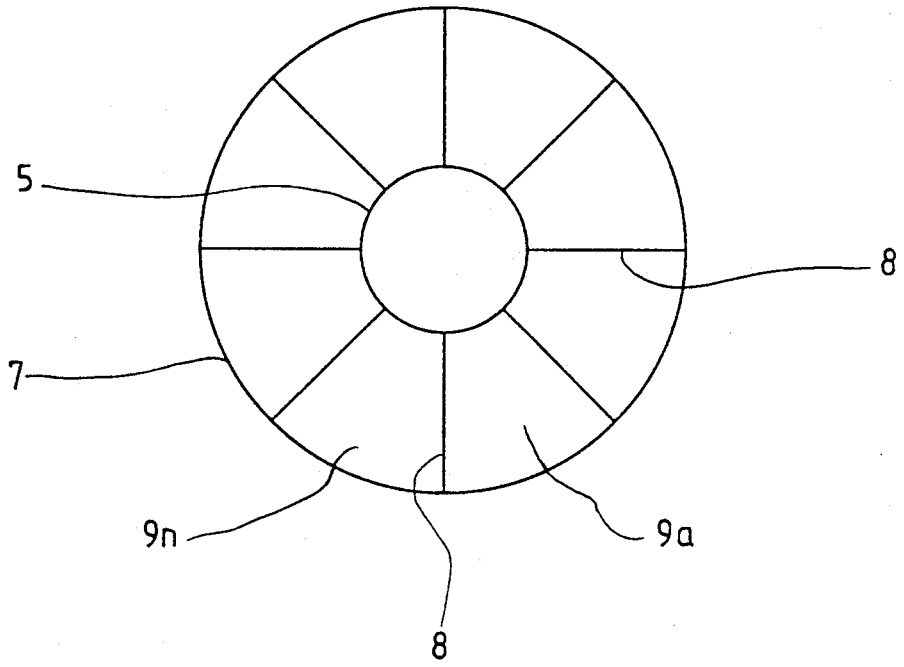
FIG. 7 is a plan view of the funnel of FIG. 5.
Figure 8:
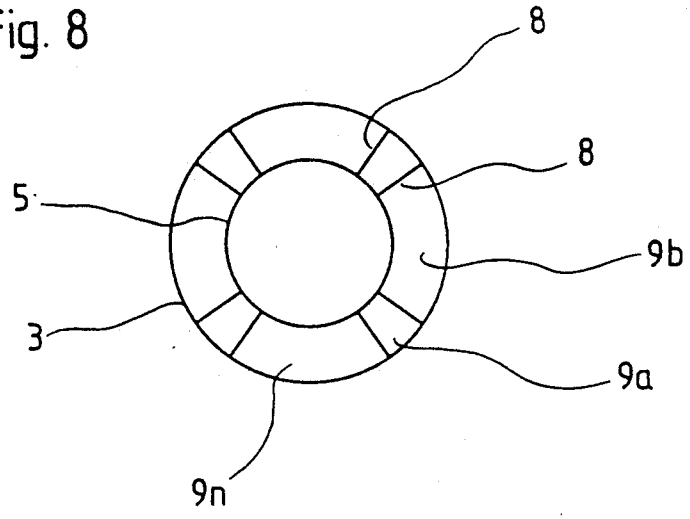
FIG. 8 is a sectional view of the funnel taken along the line VIII—VIII in FIG. 5.

FIG. 5 illustrates another variation of the funnel 7 by which the same inlet cross sections and outlet cross sections according to the funnel of FIG. 4 are attained. In accordance with FIG. 5, the sheet segments 8 are not tilted as a whole but are angled about the angle a in point P. The illustration of FIG. 8, which is a sectional view taken along the line VIII—VIII in FIG. 5, depicts the different outlet cross sections of the funnel 7 according to FIGS. 4 and 5 while FIG. 7 illustrates the equidistant arrangement of the upper edges 8*a* of the sheet segments 8 to provide identical inlet cross sections.

In all embodiments of the funnel 7, the upper edge 8*a* of each sheet segment 8 extends slantingly upwards at a certain angle from the upper perimeter of the funnel 7 toward the center pipe 5. This angle is suitably selected to exceed the angle of static friction of the bulk material. Angel hair which may be contained in the bulk material can slide outwardly along the upper edge 8*a* of the sheet segments 8 and drop in the annular space externally surrounding the funnel 7 (see e.g. FIG. 1). This secures that the compartments 9*a* to 9*n* cannot become clogged with angel hair which would otherwise impair the mixing effect and complicate cleaning of the silo vessel 1.

Figure 6:
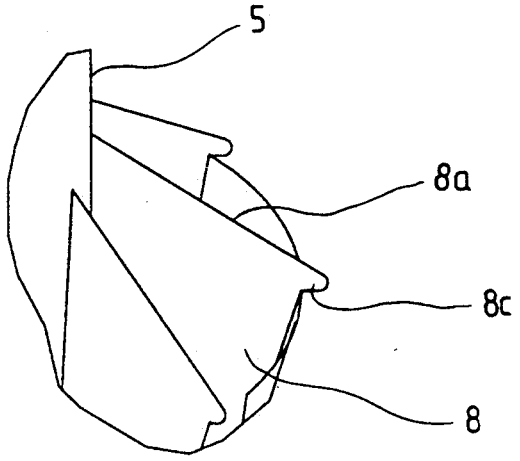
FIG. 6 is a perspective view, on an enlarged scale, of the funnel of FIG. 5, illustrating a detail X as designated in FIG. 5.

A deflection of angel hair toward the outer annular space is further improved by providing the upper edge 8*a* of each sheet segment 8 with a nose-like projection 8*c* which protrudes beyond the upper perimeter of the funnel 7 as shown in particular in FIG. 6.

Figure 9:
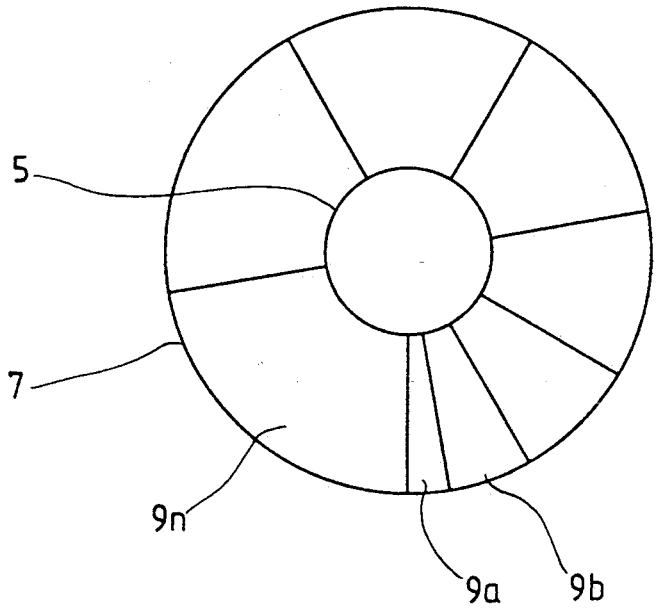
FIG. 9 is a plan view of a variation of a funnel according to the invention.
Figure 10:
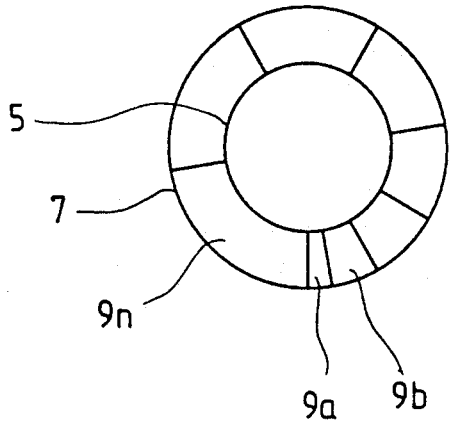
FIG. 10 is a sectional view of the funnel of FIG. 9.

FIGS. 9 and 10 illustrate a further variation of the funnel 7 for creating compartments 9*a* to 9*n* of different cross sections. As can be seen therefrom, the sheet segments 8 are not evenly spaced about the circumference of the center pipe 5 but are arranged about the center pipe 5 at gradually increasing distances. Suitably, the gradations are selected such that the cross sections of neighboring compartments increase relative to each other at a constant ratio of e.g. 1:2.

Figure 11:
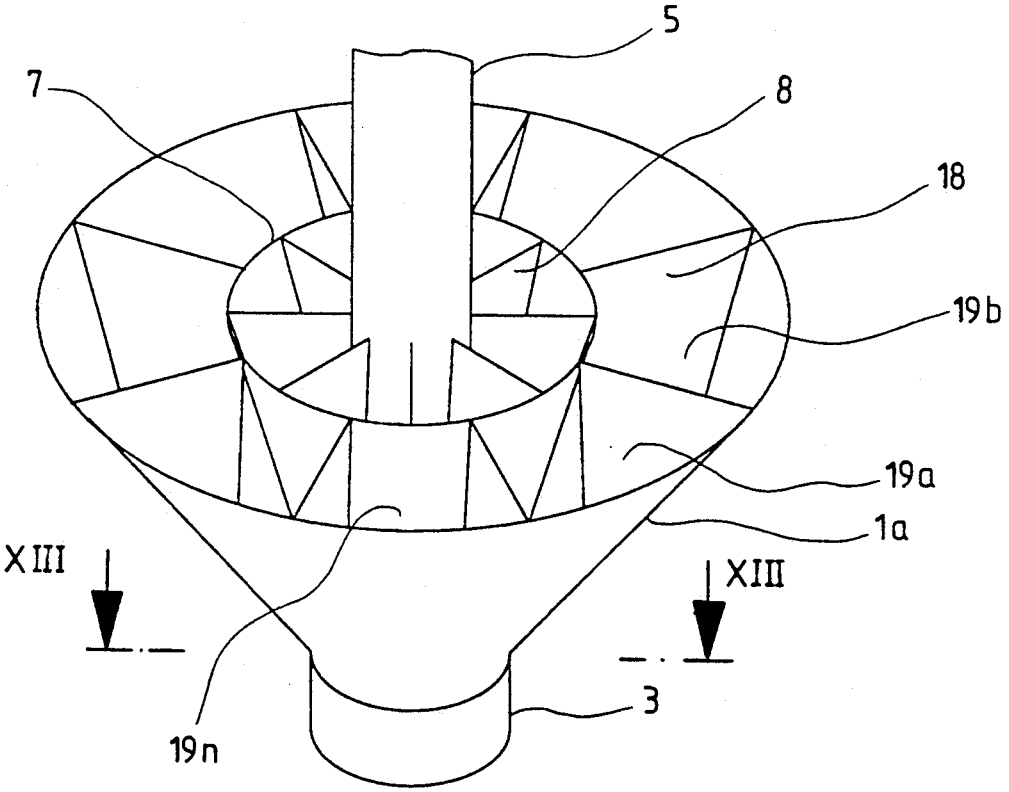
FIG. 11 is a fractional perspective view of a third embodiment of a blending silo according to the invention, illustrating in detail only an exemplified bottom part.
Figure 12:
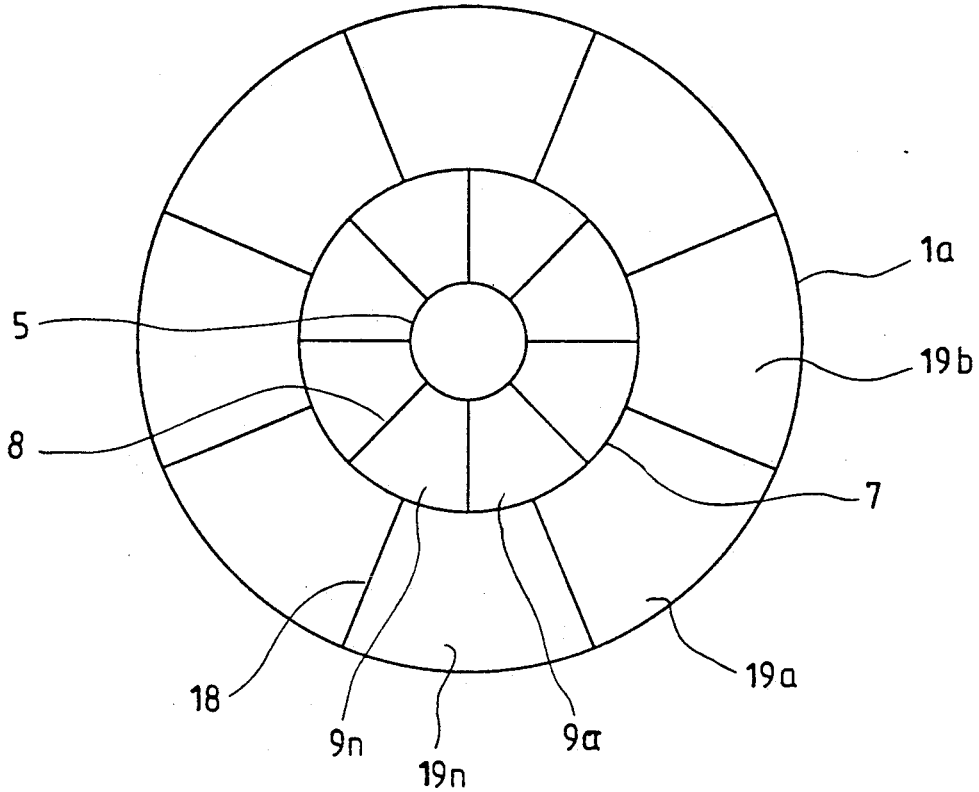
FIG. 12 is a plan view of the bottom part of FIG. 11.
Figure 13:
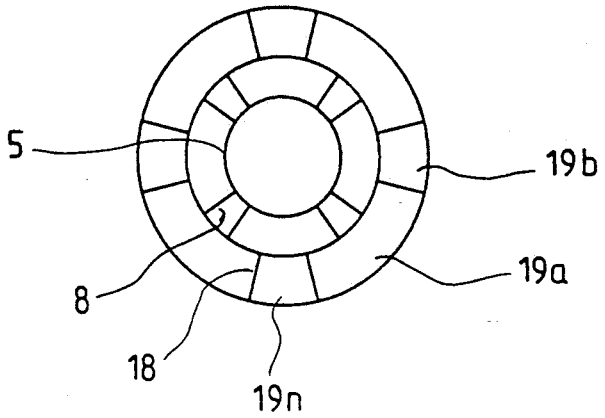
FIG. 13 is a sectional view of the bottom part taken along the line XIII—XIII of FIG. 11.

Turning now to FIG. 11, there is shown a perspective view of a modification of the conical bottom 1*a* of a blending silo according to the invention. In contrast to previous embodiments of the blending silo, the bottom 1*a* is provided with a second set of sheet segments 18 which are arranged in the space between the outside wall surface of the funnel 7 and the inside wall surface of the bottom 1*a* of the silo vessel 1. The sheet segments 18 essentially correspond to the sheet segments 8 and define a second set of compartments 19*a* to 19*n* in the space between the funnel 7 and the bottom 1*a*, with neighboring compartments 19*a*, 19*b* ... 19*n* having different outlet cross sections as shown in FIG. 13, which is a sectional view taken along the line XIII—XIII in FIG. 11. Even though FIG. 12 illustrates compartments 19*a* to 19*n* of identical inlet cross sections, it is certainly feasible to employ the same constructive means as previously described in order to alternately or additionally create compartments 19*a* to 19*n* of varying inlet cross sections. Especially in silo vessels of great diameter, the creation of additional flow zones with different sinking speed in circumferential direction results in a further improved homogenizing effect.

While the invention has been illustrated and described as embodied in a blending silo, it is not intended to be limited to the details shown since various modifications and structural changes may be made without departing in any way from the spirit of the present invention.

What is claimed as new and desired to be protected by Letters Patent is set forth in the appended claims:

1. A blending silo of the type having a silo vessel defining a center axis and provided with a conical bottom wall ending in a vessel outlet; comprising:

a funnel arranged within a central area of said silo vessel spaced from said bottom wall and tapering toward the vessel outlet, said funnel having an interior space and defining a longitudinal axis which coincides with the center axis of said silo vessel; and first separating means extending from said funnel toward said longitudinal axis for dividing said interior space in several, circumferentially spaced compartments, each of which being defined by an inlet cross section and an outlet cross section, wherein at least one element of a class which includes the set of inlet cross sections of neighboring compartments and the set of outlet cross sections of neighboring compartments is differently sized, said first separating means including a plurality of elongated first sheet segments arranged circumferentially about said funnel, said sheet segments being alternately tilted essentially along their entire axial extension relative to a longitudinal plane defined by said center axis of the silo vessel.

2. A blending silo as defined in claim 1 wherein said first separating means divides said interior space to define neighboring compartments with identical inlet cross sections and different outlet cross sections.

3. A blending silo as defined in claim 1 wherein said first separating means divides said interior space to define neighboring compartments with different inlet cross sections and different outlet cross sections.

4. A blending silo as defined in claim 1 wherein said first separating means divides said interior space to define neighboring compartments with different inlet cross sections and identical outlet cross sections.

5. A blending silo as defined in claim 1, and further comprising a center pipe extending within said silo vessel, said first separating means extending between said funnel and said center pipe.

6. A blending silo as defined in claim 5 wherein said center pipe is a riser pipe for allowing circulation of bulk material.

7. A blending silo as defined in claim 1 wherein said first sheet segments are spaced from each other in a circumferential direction at gradually increasing distances, wherein at least one elements of a class which includes the set of inlet cross sections and the set of outlet cross sections of said compartments gradually increases from a smallest value to a greatest value.

8. A blending silo as defined in claim 1 wherein said first sheet segments are spaced from each other in a circumferential direction at gradually increasing distances, wherein at least one element of a class which includes the set of inlet cross sections and the set of outlet cross sections of said compartments gradually increases from a smallest value to a greatest value by a constant ratio.

9. A blending silo as defined in claim 1 wherein said funnel defines with said bottom wall a further space, and further comprising second separating means arranged in said further space between said funnel and said bottom wall to divide said further space in further compartments, each of said further compartments being defined by an inlet cross section and an outlet cross section, wherein at least one element of a class which includes the set of inlet cross sections of neighboring further compartments and the set of outlet cross sections of neighboring further compartments is differently sized.

10. A blending silo as defined in claim 9 wherein said second separating means includes a plurality of elongated sheet segments which are of a same type as said first sheet segments.

11. A blending silo as defined in claim 10 wherein each of said first sheet segments has an upper rim extending slantingly upwards from the perimeter of said funnel toward said center axis of said silo vessel at an angle exceeding the angle of static friction of bulk material.

12. A blending silo as defined in claim 11 wherein said upper rim of each sheet segment is provided with a projection extending beyond the perimeter of said funnel.

13. A blending silo as defined in claim 9 wherein said second separating means divides said further space to define neighboring compartments with identical inlet cross sections and different outlet cross sections.

14. A blending silo as defined in claim 9 wherein said second separating means divides said further space to define neighboring compartments with different inlet cross sections and different outlet cross sections.

15. A blending silo as defined in claim 9 wherein said second separating means divides said further space to define neighboring compartments with different inlet cross sections and identical outlet cross sections.

16. A blending silo of the type having a silo vessel defining a center axis and provided with a conical bottom wall ending in a vessel outlet; comprising:

a funnel arranged within a central area of said silo vessel spaced from said bottom wall and tapering toward the vessel outlet, said funnel having an interior space and defining a longitudinal axis which coincides with the center axis of said silo vessel; and first separating means extending from said funnel toward said longitudinal axis for dividing said interior space in several, circumferentially spaced compartments, each of which being defined by an inlet cross section and an outlet cross section, said first separating means including a plurality of first sheet segments which are sequentially spaced from each other in a circumferential direction at gradually increasing distances, wherein at least one element of a class which includes the set of inlet cross sections of neighboring compartments and the set of outlet cross sections of neighboring compartments gradually increases from a smallest value to a greatest value.

17. A blending silo as defined in claim 16 wherein at least one element of a class which includes the set of inlet cross sections and the set of outlet cross sections of said compartments gradually increases from a smallest value to a greatest value by a constant ratio.

18. A blending silo for mixing bulk material of the type having a silo vessel defining a center axis and provided with a conical bottom wall ending in a vessel outlet; comprising:

a funnel arranged within a central area of said silo vessel spaced from said bottom wall and tapering toward the vessel outlet, said funnel having an interior space and defining a longitudinal axis which coincides with the center axis of said silo vessel; and separating means including a plurality of sheet segments extending from said funnel toward said longitudinal axis for dividing said interior space in several, circumferentially spaced compartments, each of which being defined by an inlet cross section and an outlet cross section, wherein at least one element of a class which includes the set of inlet cross sections of neighboring compartments and the set of outlet cross sections of neighboring compartments is differently sized, each of said sheet segments of said separating means having an upper rim extending slantingly upwards from the perimeter of said funnel toward said center axis of said silo vessel at an angle exceeding the angle of static friction of said bulk material.

19. A blending silo as defined in claim 18 wherein said upper rim of each sheet segment is provided with a projection extending beyond the perimeter of said funnel.

* * * * *